US009199772B2

(12) United States Patent
Krippendorf

(10) Patent No.: US 9,199,772 B2
(45) Date of Patent: Dec. 1, 2015

(54) TIME LOCKABLE CONTAINER AND SYSTEM

(71) Applicant: David Krippendorf, San Francisco, CA (US)

(72) Inventor: David Krippendorf, San Francisco, CA (US)

( * ) Notice: Subject to any disclaimer, the term of this patent is extended or adjusted under 35 U.S.C. 154(b) by 97 days.

(21) Appl. No.: 13/854,072

(22) Filed: Mar. 30, 2013

(65) Prior Publication Data

US 2013/0256256 A1 Oct. 3, 2013

Related U.S. Application Data

(60) Provisional application No. 61/618,598, filed on Mar. 30, 2012.

(51) Int. Cl.

| | |
|---|---|
| ***B65D 55/12*** | (2006.01) |
| ***B65D 43/02*** | (2006.01) |
| ***B65D 55/14*** | (2006.01) |
| ***E05B 43/00*** | (2006.01) |
| ***E05B 65/52*** | (2006.01) |
| *E05B 17/22* | (2006.01) |
| *E05B 47/00* | (2006.01) |
| *E05B 63/14* | (2006.01) |

(52) U.S. Cl.

CPC ..... *B65D 55/12* (2013.01); *B65D 43/02* (2013.01); *B65D 55/14* (2013.01); *E05B 43/005* (2013.01); *E05B 65/523* (2013.01); *E05B 17/226* (2013.01); *E05B 47/0012* (2013.01); *E05B 63/14* (2013.01); *E05B 2047/002* (2013.01); *E05B 2047/0024* (2013.01)

(58) Field of Classification Search

CPC ..... E05B 17/226; E05B 2047/002; E05B 2047/0024; E05B 43/005; E05B 47/0657; A61J 7/0069; B65D 43/02; B65D 55/14

USPC ..... 70/63, 267–274, 158, 163, 166–169, 70/232; 128/202.13; 109/45, 49.59 R, 61; 340/5.62, 5.73, 5.28; 220/200, 211; 215/200; 224/197

See application file for complete search history.

(56) References Cited

U.S. PATENT DOCUMENTS

| | | | | | |
|---|---|---|---|---|---|
| 3,660,998 | A * | 5/1972 | Ishijima | 70/269 |
| 3,851,506 | A * | 12/1974 | Simon | 70/271 |
| 4,076,118 | A * | 2/1978 | Karlsson | 206/268 |
| 4,224,814 | A * | 9/1980 | Bechtiger | 70/272 |
| 4,248,175 | A * | 2/1981 | Navarro | 119/51.12 |
| 4,412,436 | A * | 11/1983 | Bechtiger | 70/272 |
| 4,425,853 | A * | 1/1984 | McGregor et al. | 109/25 |
| 4,572,403 | A * | 2/1986 | Benaroya | 221/3 |
| 4,774,512 | A * | 9/1988 | Jolidon et al. | 340/5.22 |
| 5,016,453 | A * | 5/1991 | Bonnice et al. | 70/93 |
| 5,129,536 | A * | 7/1992 | Robinson | 220/211 |
| 5,594,430 | A * | 1/1997 | Cutter et al. | 340/5.22 |
| 5,774,059 | A * | 6/1998 | Henry et al. | 340/5.54 |
| 5,826,715 | A * | 10/1998 | Thompson | 206/261 |
| 6,825,753 | B2 * | 11/2004 | Cardinale et al. | 340/5.73 |
| 6,880,722 | B2 * | 4/2005 | Anderson et al. | 221/71 |
| 7,132,925 | B2 * | 11/2006 | Johnson et al. | 340/5.73 |
| 7,671,719 | B2 * | 3/2010 | Sogo | 340/5.73 |
| 7,768,378 | B2 * | 8/2010 | Hill et al. | 340/5.73 |
| 8,800,488 | B2 * | 8/2014 | Stone | 119/51.01 |
| 8,950,223 | B1 * | 2/2015 | Joyce | 70/63 |
| 2003/0230124 | A1 * | 12/2003 | Johnson et al. | 70/267 |
| 2005/0146419 | A1 * | 7/2005 | Porter | 340/5.73 |
| 2005/0172964 | A1 * | 8/2005 | Anderson et al. | 128/203.21 |

(Continued)

*Primary Examiner* — Suzanne Barrett

(57) ABSTRACT

A time-lockable storage container having a single actuation button/dial to input a time period to lock the container.

6 Claims, 9 Drawing Sheets

(56) References Cited

U.S. PATENT DOCUMENTS

2008/0203107 A1* 8/2008 Conley et al. ..... 221/1
2009/0134209 A1* 5/2009 Tonaltzin ..... 229/116.1
2011/0210136 A1* 9/2011 Wang ..... 220/831
2012/0272694 A1* 11/2012 Abalkhail ..... 70/63

* cited by examiner

TIME LOCKABLE CONTAINER AND SYSTEM

CROSS-REFERENCE TO RELATED APPLICATIONS

This application claims priority to the following U.S. Provisional Patent Application, of which is hereby incorporated by reference in its entirety: U.S. Ser. No. 61/618,598 filed Mar. 30, 2012.

BACKGROUND OF THE INVENTION

1. Field of the Invention

The present embodiments relate generally to the field of storage containers. More specifically, the present embodiments relate to restricted access containers that can be locked for a set period of time. The present embodiments may relate to food storage as well as other types of storage, for example, storing electronic devices or controllers so that they cannot be accessed for a set period of time.

2. Description of the Prior Art

It is known that human beings often lack the will power required to achieve the goals they set for themselves. Whether the goal is to consume less food that may be detrimental to their health, to limit the amount of time spent on an electronic device or video game, or any other conceivable uncontrolled behavior, assistance is often needed to help these individuals moderate, reduce or eliminate bad behaviors. One way of doing so is through an intervention method that helps reduce or eliminate time spent engaging in negative or non-moderated behavior.

Examples of the types of food products that may be detrimental to one's health may include tobacco, alcohol, foods high in fat, foods high in sugar, or any other food product known to cause unwanted side-effects such as weight-gain, addiction and so forth.

Additionally, it is known that some people would like to limit the amount of time they, or more specifically their children, spend using electronic devices and/or video games. Examples of electronic devices may include cellphones, smartphones, ipods, Nintendo DS, power cords, remote controls, and other known electronic devices and video games controllers or consoles.

In some instances, individuals will place a credit card in a container with water in it and freeze the water, so as to prevent the individual from using the card for a period of time e.g. when going out on the weekend. This frozen credit card on ice is meant to deter the individual from using the card until it melts.

Other needs that may require intervention include: keeping cash away from people who impulsively spend before rent/credit card payments are due; keeping keys from people who plan to drink and don't want to be tempted to drive; preventing persons from overtaking/overdosing prescription drugs; taking away power cords and remote controls to prevent excessive use of electronics; locking alcohol away from those who might drink too much; locking away car/house keys to prevent use of car/house; locking away toys/sports equipment until homework is finished or as a consequence/punishment; locking or storing passwords required to access facebook, tablets, computers, televisions, etc.; and even holding money for a prize, contest, or when a bet is placed.

The desire to find a way to moderate food consumption, use of electronic devices, money, gadgets and so forth in one's home is well documented by the number of self-help, parenting, and weight loss products currently on the market.

Certain locking devices exist to address this problem; however, they tend to be bulky, contain lots of parts or buttons, and limiting on accessibility into a container when unlocked. A need therefore exists for a time-lockable device to help assist with self-control, that is easy to use, allows for maximum access into the container, and is not bulky.

The following application seeks to solve the problems stated.

SUMMARY OF THE INVENTION

Illustrative embodiments of the present invention shown in the drawings below are more fully described in the Detailed Description section. It is to be understood that there is no intention to limit the invention to the forms described in this Summary of the Invention or in the Detailed Description. One skilled in the art can recognize that there are numerous modifications, equivalents, and alternative constructions that fall within the spirit and scope of the invention as expressed in the claims.

The present application provides a time-lockable storage system for storing items therein for a set period of time.

In one illustrative embodiment a storage system includes a lid comprising a multi-degree actuating button configured to set a period of time and engage a locking mechanism, wherein said locking mechanism is configured to engage at least one female mating portion formed on a side of a container. The locking mechanism remains in a locked position until the set time period is exhausted, whereupon the locking mechanism disengages or is in a state to be disengaged.

In one embodiment the button is configured to elevate when the time period is expired.

In one embodiment the lid comprises an electrical timer powered by a battery source, while in another embodiment the timing mechanism is purely mechanical.

In one embodiment the lid provides at least two locking mechanisms configured to engage with at least two female portions formed on two sides of a container for storing items.

In one embodiment, an airtight or hermetic seal is formed when the lid is engaged with the container.

In one embodiment a time-lockable system is comprised of a lid and a container, wherein the lid further comprises a lid housing having a button, a plurality of toothed gearing cylinders contained within the housing, and a partially toothed piston rod having a tab. The container further comprises receiving tabs that receive the tabs located on the partially toothed piston rod.

In another embodiment, a button formed in a lid may be comprised of a cam that actuates followers to and from the center of the lid, wherein a locking and open position are achieved. The button may be a single unit, or comprised of a spring and at least one cam having teeth to engage followers.

In one exemplary embodiment a container comprises a locking mechanism having a settable timer, wherein the locking mechanism is attached to or disposed within the container and is configured to engage with a mating portion of a removable lid. Furthermore, a display screen, power source, and actuating button may be integrated into the container. The mating portion of the lid may include male or female type mating configurations, e.g. a female mating portion may be comprised a plurality of slots in the removable lid.

In another embodiment a time lockable container, comprises a container having at least one receiving element formed in a sidewall of the container; and a lid comprising: a housing having a button, a cam system placed within the housing and configured to protract and retract at least one male locking component, a timing device configured to prevent motion of the male locking component, wherein the male locking component is configured to mate with the receiving element, thereby securing the lid to the container. The lid may further include a slot extending from outer portion of the lid into the container when in a secured position. This slot may used to insert items into the container while in a locked state e.g. credit cards.

These and other embodiments are described in more detail herein.

DETAILED DESCRIPTION OF THE PREFERRED EMBODIMENT

The current application and embodiments relate to a time-lockable storage container.

It should be understood that time-lockable refers to a system that is locked for a period of time and wherein the period of time may be any predetermined amount of time. Time-lockable does not preclude other mechanisms from overriding a locking mechanism, but such capabilities tend to negate the intended uses of the system.

Figure 1A:
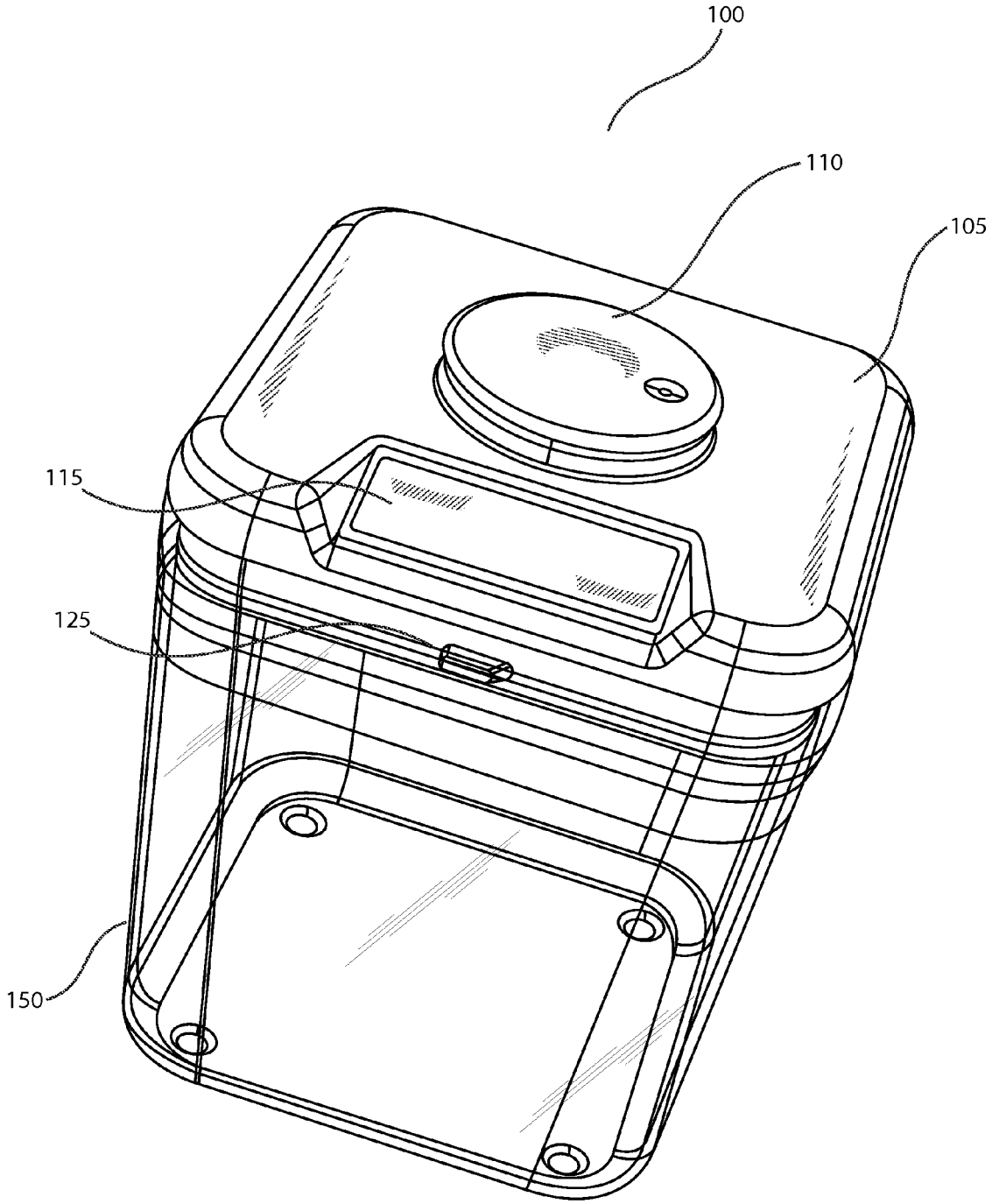
FIGS. 1A-B illustrate various views of a single-button time-lockable container.
Figure 1B:
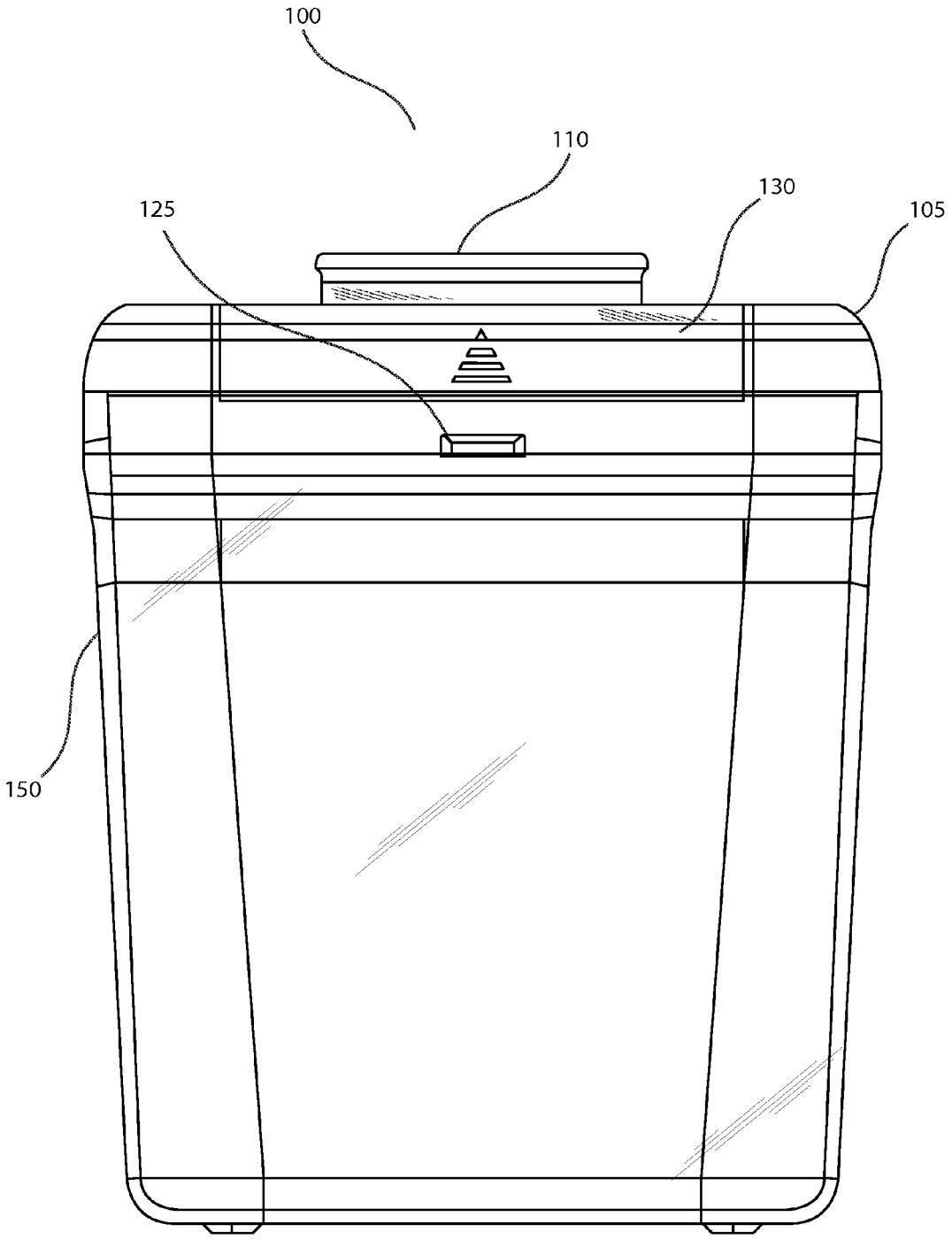

In one exemplary illustrated in FIGS. 1A-B, a time-lockable system 100 may be separated into two major components: a lid 105 and container 150.

The lid 105 may be further comprised of a single multi-degree actuating button 110 that is positioned in a central portion of the housing of the lid and configured to extend above the lid in one mode or be completely contained within the housing portion of the lid in another mode. The button may rotate clockwise, counter-clockwise, be depressed or popped up. In other embodiments an additional tilting degree of freedom is incorporated therein and similar to a trackball or trackpoint mechanism.

In addition, a display screen 115 may be formed on the upper or top portion of the lid and configured to display, date, time, locked/unlocked state, time until release of locking mechanism and so forth. Also included in the embodiment shown is an internal power supply that is accessible via a removable cover 130, as well as internal locking mechanisms configured to engage female mating portions 125 formed in the sidewalls of a container 150.

In other embodiments, slots or slits may be added to the lid that allow for credit cards or money to be inserted into the container like a piggy bank. Sound and light generating devices may be incorporated into the lid that indicate various actions or states such as when it is locked, when the time period has expired, a countdown till opening and so forth. LEDs are one example of a light source and as well as others known in the art. In some embodiments vibrating mechanisms causing the system to vibrate may incorporated into the system, such as those integrated into mobile phones or stuffed animals. For example, a 'beeping' sound may occur indicating the container is locked or time has expired.

Music, pre-recorded voices, and so forth may also be used. In some configurations a mic configured to record an audio file that is associated with the time-lockable system has been contemplated. The audio file may stored in memory within the system and managed by the controller unit stored therein.

In other embodiments, the lid is configured to be dishwasher safe wherein the internal components are insulated sufficiently to withstand the hot temperatures exposed to in a dishwasher environment including stressed caused by any expansion or contraction caused by the change in temperature. In addition, the dishwasher safe configurations may also be adequately sealed off to prevent water from entering internal gear mechanisms or electronic components. Some of the materials used to seal components include using various silicon, rubber, or plastic materials configured to handle the extreme environment of a dishwasher.

The container 150 may be formed or crafted using a single piece of clear plastic. The container may be injection molded, machined, pressed, or formed using other methodologies known in the art for manufacturing a container. In other configurations, the container 150 may be formed of other materials including: wood, metal, glass, or clay. Female mating portions 125 or slots shown in FIGS. 1A-B are located near the top of every sidewall of container 150. When the lid 105 is placed onto the container 150, mating portions 125 provide a path for the lid's internally stored engaging/locking mechanism (not shown in these figures), such as cam followers, to be partially inserted during the locking and unlocking action, which temporarily secures the lid to the container for a specified time period.

In another embodiment the locking mechanism is comprised of extendable arms that slide into or under tabs, slots, or through holes formed in the sidewalls of the container, thus preventing the removal of the lid. In another embodiment only partially formed slots or cavities are formed in sidewall (s) of the container.

In another embodiment, a securing mechanism formed into or as part of the container may provide a means for a user to secure the container onto a surface or wall. For example, one securing mechanism may be a protruding tab having a hole therein, wherein a cable lock, bolt or other attaching/locking mechanism may pass through and secure or fix the container portion of the time-lockable system to a desired location. In other embodiments the securing mechanism may be comprised of a magnet, or any other attachment device that is permanent or removably attachable.

Figure 2A:
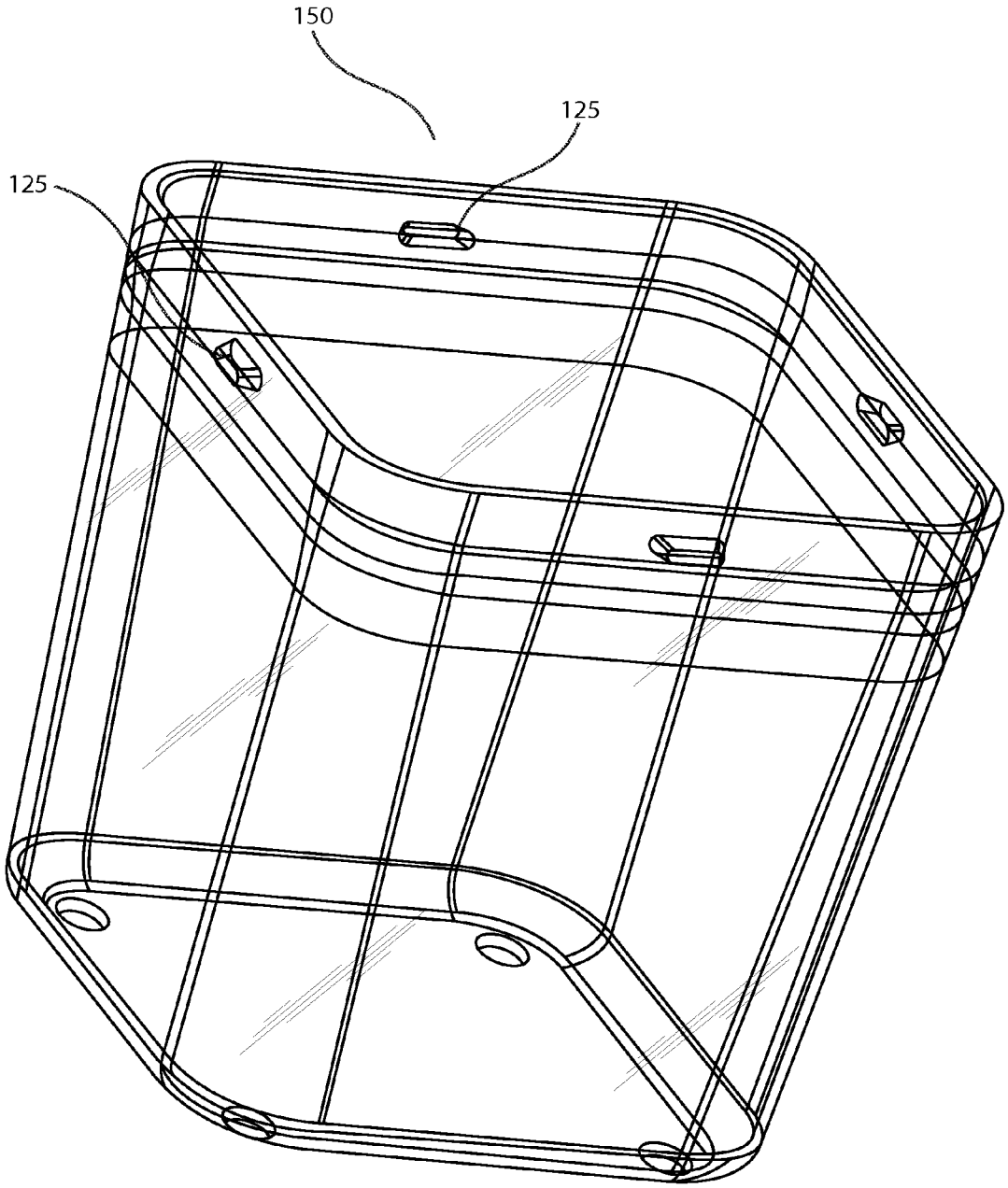
FIGS. 2A-C illustrate various views of the container portion of a time-lockable container.
Figure 2B:
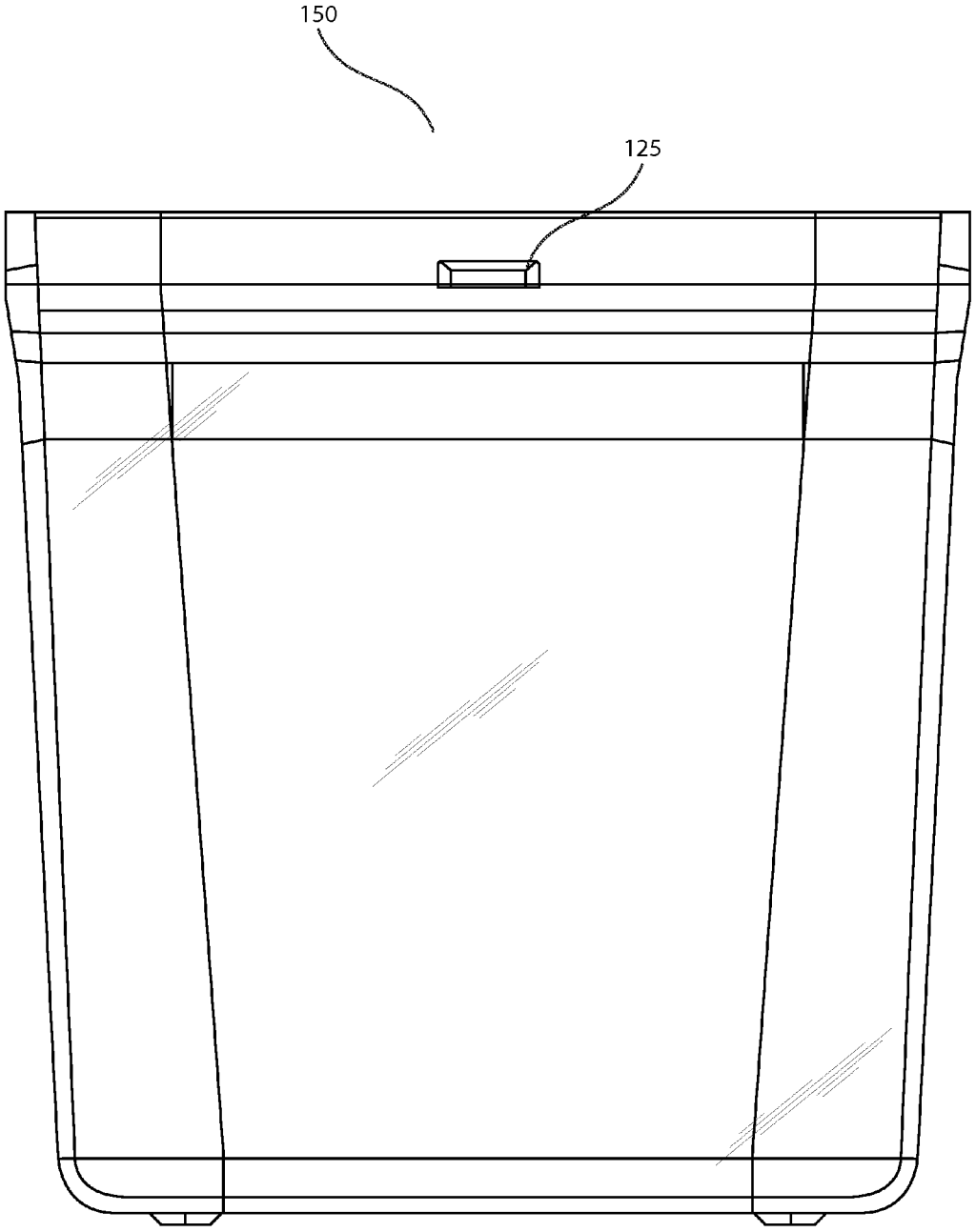
Figure 2C:
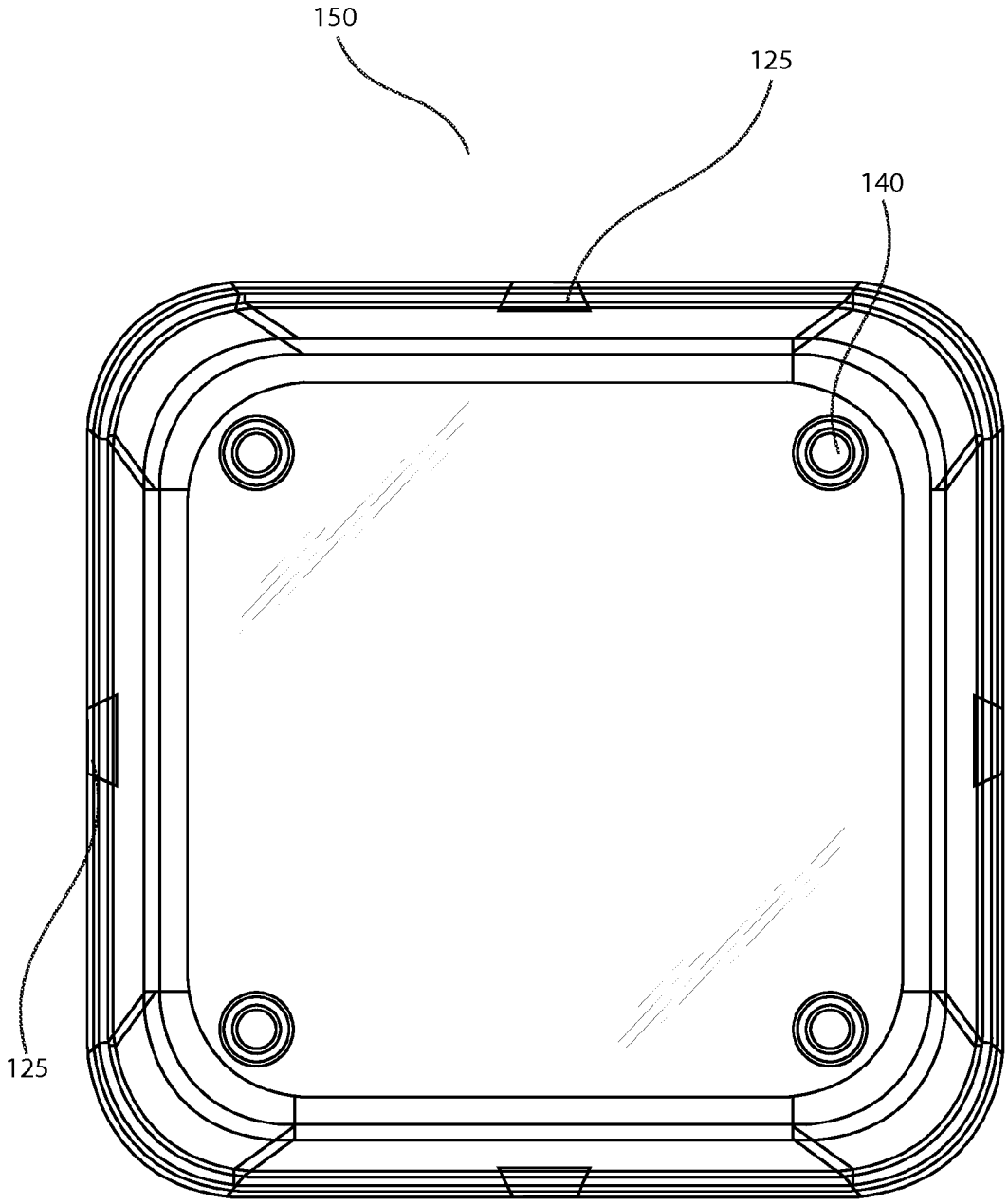

FIGS. 2A-C illustrate perspective, side, and bottom views of container 150. In this embodiment the container is formed having a rounded square opening that slightly reduces in size towards the bottom of the container. Pads or feet 140 are formed into the base of the container. Again the female mating portions 125 or shown integrated into each of the four sidewalls shown and place near the top of the container where the lid will rest or be inserted therein.

It is contemplated that the container portion of the time-lockable system may take on any shape having any number of sidewalls, or mating connection points (such as tabs, slots and the like). Likewise, a matching lid would be configured to match the opening portion of the container. Some shapes include rectangular, circle, oval, hexagon, and other openings. In addition, some embodiments include handles or grasping lips/edges formed into the sidewall(s) of the container.

Figure 3A:
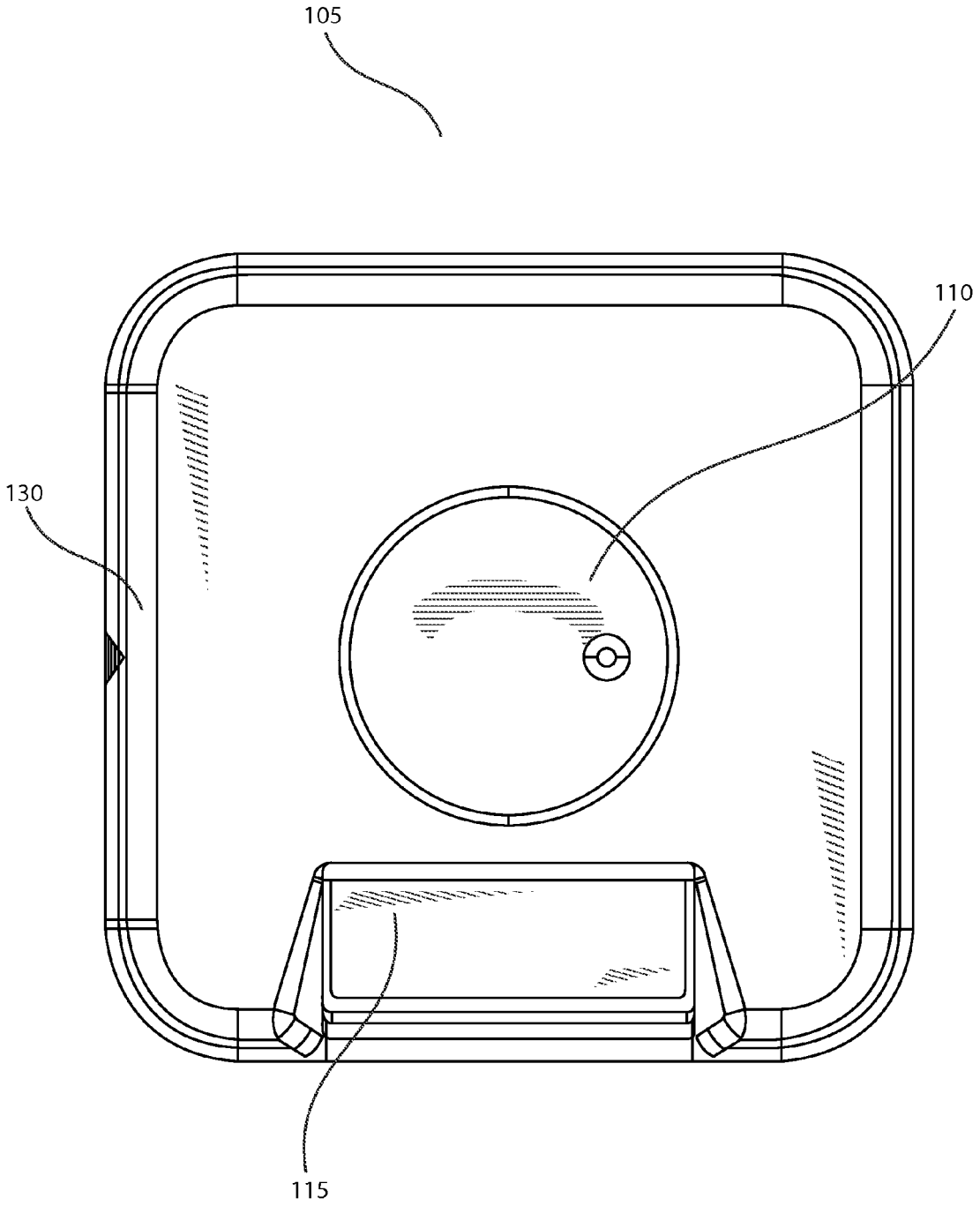
FIGS. 3A-D illustrate various views of the time-lockable lid portion of a time-lockable container including internal portions of the lid.

FIGS. 3A-D illustrate various views of one embodiment of a time-lockable lid including components. FIG. 3A illustrates a top view of lid 105, showing the button 110, display screen 115, and removable cover 130 for accessing an internal power supply such as rechargeable batteries.

Figure 3B:
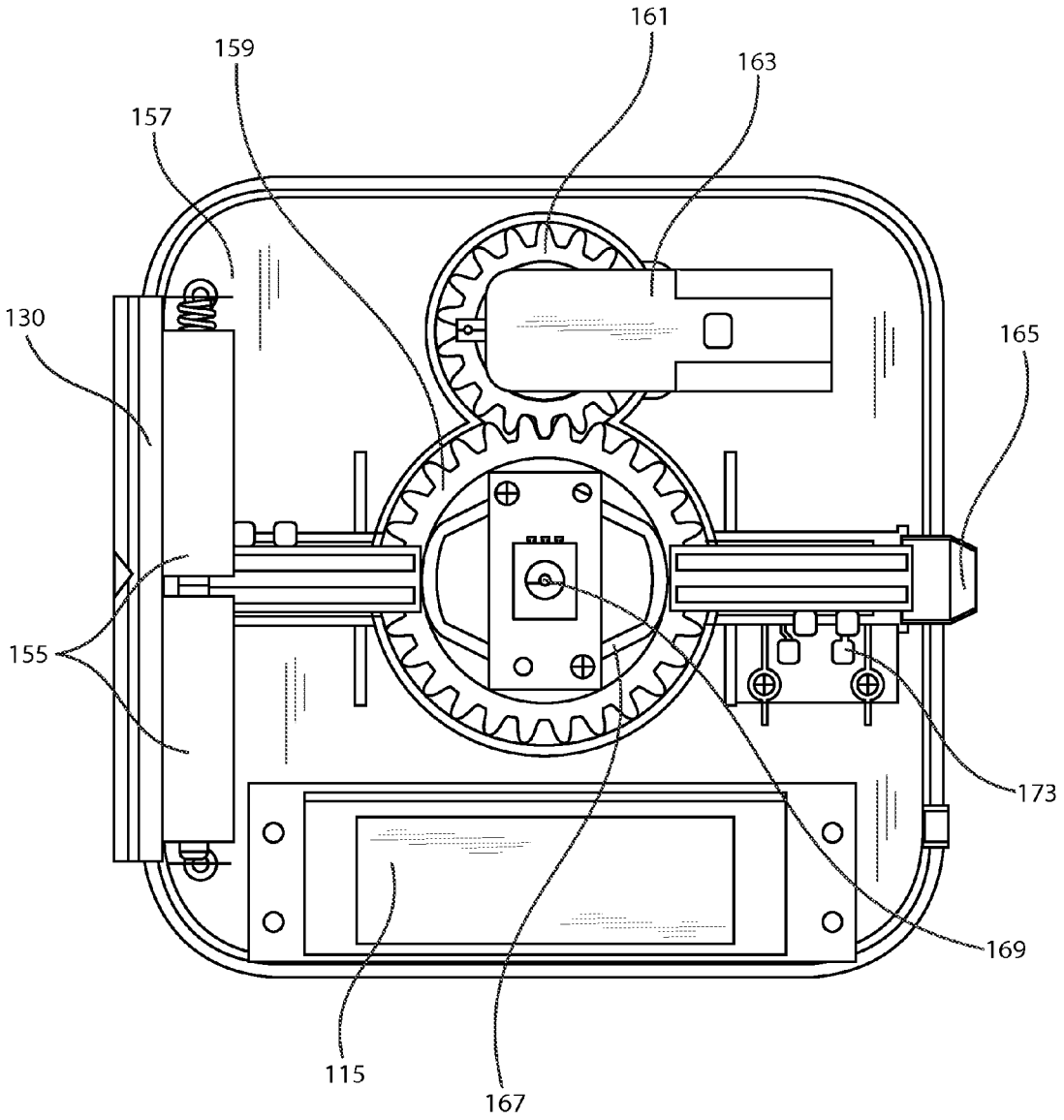

FIG. 3B illustrates various internal components of lid 105, where a portion of the lid housing as well as button 110 have been removed. Internal components shown include batteries 155, electrical leads 157, and main gear 159 for causing cam 167 to rotate, which forces a locking mechanism, such as cam followers 165 to protract and retract. A drive motor 163 receives power from the batteries 155, and rotates a drive gear 161, that causes rotations of the main gear 159. A rotary sensor 169 detects the degree and direction of rotations from button 110. The rotary sensor 169 may then provide the button's rotational data to an internal control unit 171 that uses the incoming data to adjust the timer and also outputs the timer information to display screen 115. Limiting switches 173 may serve to detect how far the cam followers have protracted/retracted and ensure the motor turns on or off when the cam followers have reached their desired protracted or retracted state.

Figure 3C:
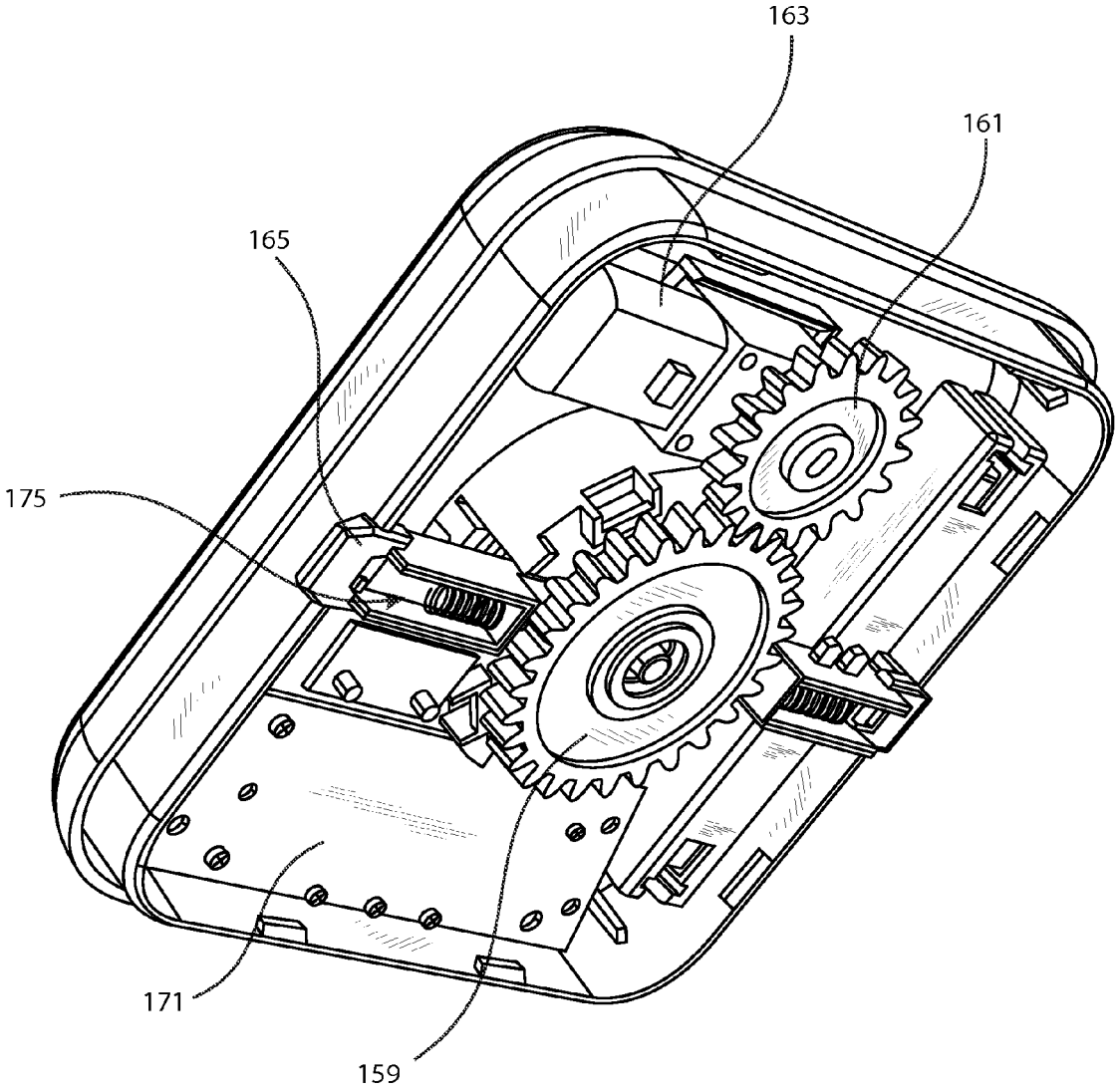
Figure 3D:
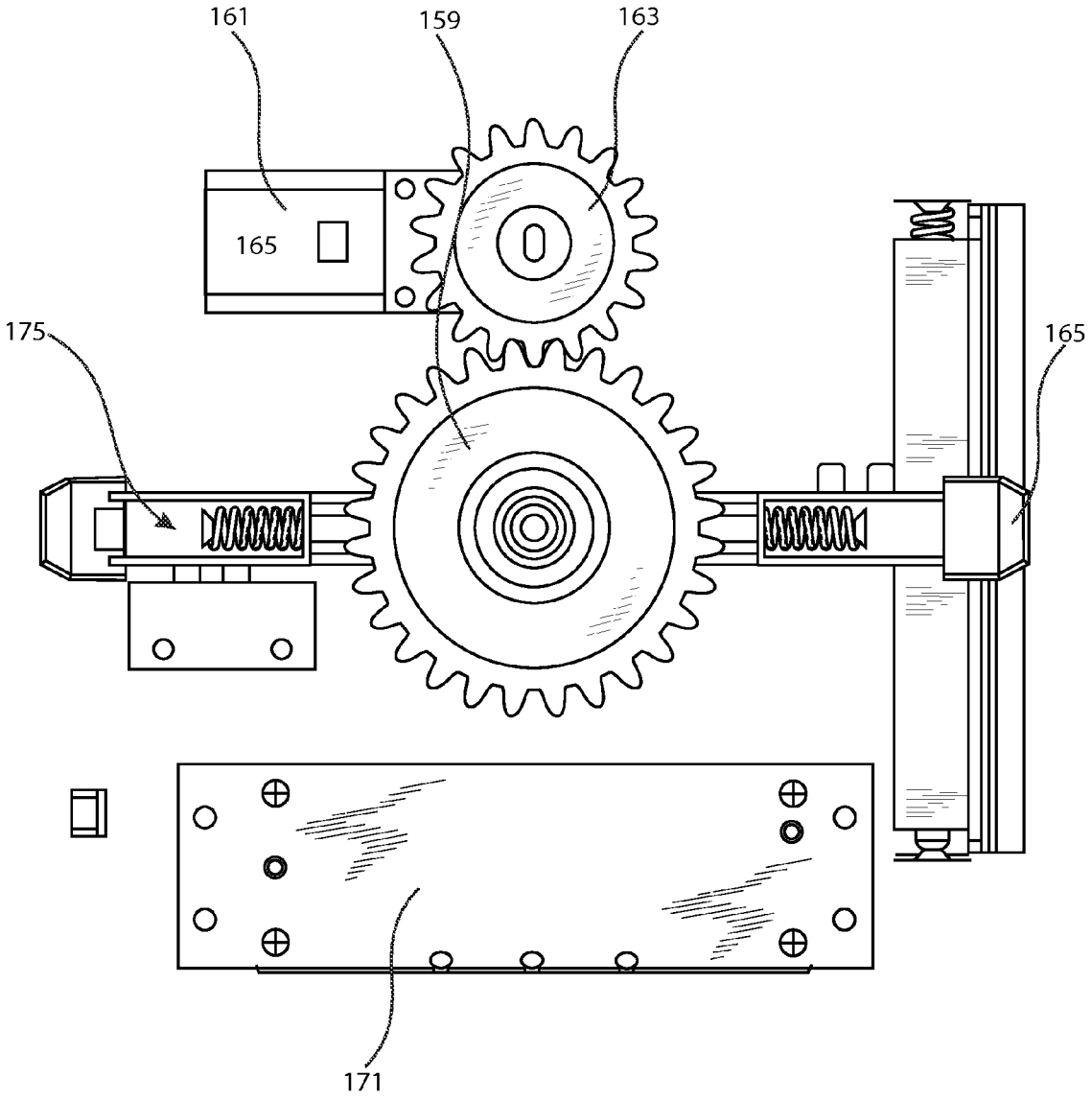

FIG. 3C illustrates a perspective underneath view of the lid 105, wherein a portion of the lid housing has been removed to show internal components from a different view. Shown here are two cam followers 165 actuated by cam 167, which is hidden in this view and driven by main gear 159 that is connected to and rotated by driving gear 161, which is rotated by driving motor 163. Internal control unit 171, a PCB having a microcontroller and memory, is shown located on the underside of display screen 115. The integrated springs 175 of the cam followers 165 combine with the rotating cam 167 to provide the force needed to extend or retract the cam followers. When the cam followers are retracted, the lid is in its unlocked state, the opposite is true when the cam followers are protracted or extended outwards. Similarly FIG. 3D, shows a bottom view of the internal components of lid 105 wherein the lid housing has been completely removed.

The multi-degree actuating button 110 shown in the various figures is located near the center and topside of the lid 105 and provides or functions as an interface. This button may used to set the amount of time the container is to be locked for. For example in one configuration, rotating the button clockwise or counterclockwise while the lid is in its unlocked state will increase or decrease amount of time (shown on display). Once the desired amount of time is set, depressing the button/dial may begin a brief countdown before the lid enters into its locked state (i.e. where cam followers extend into female mating portions). If the button is depressed a second time before the countdown expires, the lid will not enter into its locked state and the user will have the option to further adjust the timer. This interruption feature helps prevent accidently locking the device for an incorrect amount of time. In some configurations when the lid is locked (cam followers extended), the button serves no function. Only once the time expires and the lid returns to its unlocked state (cam followers retracted) will the functionality of the button/dial be restored. Whereas in some configurations the button may serve to add additional time while in a locked state.

Another embodiment is contemplated where instead of a button/dial, a capacitive touch interface is used to set the timer. The button 110 illustrated in the embodiments shown, functions as an interface to an internal control unit 171 to set time and initiate a locking sequence. However, in other embodiments the button may be used to mechanically actuate or set timing mechanisms and cam followers/locking mechanisms. For example, the actuator button may help wind a coiled spring or series of coiled springs that force a cam or other mechanism to rotate into a locked position and remain there until a release mechanism disengages the locking mechanism. The rotation of the dial may simultaneously engage the locking mechanism into place, while adding time to a timing mechanism controlling the disengaging mechanism.

The removable cover 130 provides access to the portion of the lid that houses batteries 155 required to power the lid for electro-mechanical embodiments. A user may remove the door to access or replace the batteries when necessary. Other embodiments exist where the batteries or internal power source are inaccessible but can be recharged by connecting a power cable to the device. In some instances the batteries or power supply are inaccessible while the system is in a locked state.

As discussed above, the electric or driving motor provides a force necessary for the lid to switch between the locked and unlocked state. The gears driven by the electric motor provide the transmission required to rotate the cam. A microcontroller and two limit switches monitor the electric motor's output to ensure the cam rotates in a predictable and controlled fashion. Another embodiment can exist where instead of an electric motor, the locking and unlocking of the device is accomplished using springs or other mechanical means.

In one configuration, when the lid is in a locked state, the internal control unit continuously logs the remaining time and stores that information in memory. If the power supply fails (i.e. battery dies or is removed) the device will remain in its locked state (or unlocked state if the container was previously unlocked prior to failure). When power is restored the timer will continue counting down from the time last logged before the loss of power.

In some embodiments a timer log continues to run when power is pulled or lost, such that the device will returns to its state before power fail, but will continue counting down from the last time logged in memory.

The embodiments shown in the figures provide for two cam followers; which allows the lid to be placed on the container such that only two of the 4 female mating portions are engaged. The number of locking mechanisms and mating portions may vary from each design. For instance, a three and four cam follower system is contemplated.

As mentioned in the referenced provisional application, embodiments exist where no mating portion exists in the sidewall of the container. Instead, the force of the cam followers or extension mechanism causes a pressure sufficient between the sidewalls and lid to prevent the lid from being removed. In some instances it may desirable to not have grooves, ridges or mating portions formed into the sidewall of the container for instances where the contents stored therein may be poured out of the container like chocolate candies.

In some embodiments it is contemplated that a code may be entered or required to open the lid, thereby indefinitely preventing others from opening the lid. The code may be entered through the interface of the lid, such as the actuating button/dial, other mechanical means, touch screen or other electronic means contained in the lid.

As mentioned above, a hermetic seal may be formed between the lid and container. A gasket or silicon ridge formed along the joining edges may be used to form this hermetic seal with the time-lockable storage system.

In additional configurations, the locking mechanism, timing mechanism, user interface mechanism (button, touch screen, dial, etc.) may all be directly incorporated into the container itself, where a removable lid (some with or without mating portions) is locked or secured into place. Likewise the power supply, controller unit, wireless transmitters/receivers may also be incorporated directly into the container part of the time-lockable system.

In one such configuration, the locking mechanism and timing mechanism are incorporated into a lid that is adapted to lock onto another container such as wine or liquor bottles, bowls, cups, and other container like devices. For these type of containers the locking mechanism may be configured to expand or extend into the container and under a lip or ridge. Alternatively, they may press fit into the opening portion of the container where the lid would be placed over or in.

The locking and time mechanism may even be formed in a separate device that is configure to be used to lock other containers that close themselves, such as refrigerators, utility boxes and the sort.

Some user interface mechanisms described above include actuating buttons/dials, touch screens and so forth. This may also be extended to wireless devices, such as computers, smart phones, tablets, and so forth.

In other embodiments a remote control device may be configured to work in conjunction with the timing and locking mechanism to engage or disengage the locking mechanism in the lid, add time, or otherwise communicate with electronics contained in the lid.

By way of example, one configuration contemplated has no external user interface mechanisms formed on the lid or container portion of the system, but contains a wireless transmitter that is connected to an application running on a mobile device (such as an iPhone) via Bluetooth, wireless, or other radio frequencies and protocols. The user may then input into the application running on the mobile device the amount of time till the device is unlocked and the application may even send updates to other wireless devices indicating locking actions, time till the container is unlocked, motivational quotes and so forth. Additionally, a 'master key' in the form of permissions on the application may allow an administrator to unlock the time-lockable container sooner than the countdown. Alternatively, the administrator functionality or others may add time to the time-lockable container.

The application can run the timer on the mobile, or external device from the time-lockable system and send appropriate signals to the time-lockable container or device to lock or unlock. Alternatively, the application can send a packet of information containing the timing and other information, which is run through the internal control system of the time-lockable device.

While several embodiments have been described herein that are exemplary of the present invention, one skilled in the art will recognize additional embodiments within the spirit and scope of the invention.

What is claimed is:

1. A time locking lid comprising:

a housing;

a locking mechanism partially disposed within the housing;

a user interface mechanism configured to set a code for engaging the locking mechanism, further the user interface mechanism comprising a single multi-degree actuator button slidably and rotatably attached to the housing, wherein the single multi-degree actuator button configured to set a code for locking the engaging mechanism; and a timing device receives input from the user interface mechanism, and the timing device further configured to determine the locking state of the locking mechanism.

2. The time locking lid according to claim 1 wherein the single multi-degree actuator button wound to one or more coiled springs that force a cam to rotate into the locked position.

3. The time locking lid according to claim 1 further comprising a wireless device controller configured to receive input from a wireless transmitting device.

4. The time locking lid according to claim 1 further comprising a port for an external power supply.

5. The time locking lid according to claim 1 further comprising a display screen formed on the housing.

6. The time locking lid according to claim 1 further comprising a power source and a motor configured to actuate the locking mechanism.

* * * * *